United States Patent [19]

Ari et al.

[11] Patent Number: 4,465,242

[45] Date of Patent: Aug. 14, 1984

[54] METHOD AND APPARATUS FOR INSERTING THREADS AND SIMILAR ITEMS INTO A WINDING DEVICE

[75] Inventors: Necati Ari, Winterthur; Ruedi Schneeberger, Seuzach, both of Switzerland

[73] Assignee: Rieter Machine Works Ltd., Winterthur, Switzerland

[21] Appl. No.: 395,036

[22] PCT Filed: Oct. 23, 1981

[86] PCT No.: PCT/EP81/00170

§ 371 Date: Jun. 15, 1982

§ 102(e) Date: Jun. 15, 1982

[87] PCT Pub. No.: WO82/01540

PCT Pub. Date: May 13, 1982

[30] Foreign Application Priority Data

Oct. 31, 1980 [CH] Switzerland ..... 8117/80

[51] Int. Cl.[3] ..... B65H 54/02; B65H 54/20

[52] U.S. Cl. ..... 242/18 PW; 242/35.5 R

[58] Field of Search ..... 242/18 PW, 18 R, 18 DD, 242/35.5 R

[56] References Cited

U.S. PATENT DOCUMENTS

| | | | |
|---|---|---|---|
| 588,378 | 8/1897 | Bean et al. . | |
| 2,108,111 | 2/1938 | Ehrlich | 242/107 |
| 2,189,364 | 2/1940 | Kirsten | 248/79 |
| 2,812,640 | 11/1957 | Hartley | 254/394 |
| 2,998,202 | 8/1961 | Keith et al. | 242/18 PW |
| 3,145,725 | 8/1964 | Knights | 137/355.17 |
| 3,599,887 | 8/1971 | Maverna | 242/47.5 |
| 3,782,648 | 1/1974 | Ito et al. | 242/35.5 R |
| 3,964,721 | 6/1976 | Owens et al. | 242/18 PW |
| 4,023.741 | 5/1977 | Schar | 242/18 PW X |
| 4,069,983 | 1/1978 | Muramatsu et al. | 242/18 PW |

*Primary Examiner*—Stanley N. Gilreath

*Attorney, Agent, or Firm*—Werner W. Kleeman Flanagan

[57] ABSTRACT

The apparatus for safely inserting threads into individual bobbin tubes of a winding device comprises a suction gun to displace the threads from first thread guides provided at the apex of the traversing triangle to movable thread guides which are at first placed at the free end of a bobbin chuck. Subsequently these thread guides are moved to place the threads into a position in front of corresponding catching means which are formed at the bobbin tubes. The threads then are simultaneously caught by the catching means as the thread guides are jointly pivoted towards the bobbin tubes. Thereafter, the winding process is simultaneously started at all bobbin tubes.

8 Claims, 13 Drawing Figures

METHOD AND APPARATUS FOR INSERTING THREADS AND SIMILAR ITEMS INTO A WINDING DEVICE

CROSS-REFERENCE TO RELATED APPLICATION

This application is related to the commonly assigned, copending U.S. application Ser. No. 06/395,037, filed Jun. 15, 1982, entitled "Method and Apparatus For Inserting Threads And Similar Items Into a Winding Device."

BACKGROUND OF THE INVENTION

The present invention relates to a new and improved method and apparatus for inserting threads and similar items into a winding device including at least two traversing devices arranged axially adjacently and associated bobbin tubes placed on a bobbin chuck.

In its more particular aspects the method of inserting threads and the like is of the type comprising the steps of taking up each thread, coming from a first thread guides arranged above the winding device, by a thread suction device, subsequently placing the threads onto a second thread guide arranged above the traversing device and onto individual lower thread guides arranged below the thread traversing device and guiding the same outside a thread traversing zone, displacing the threads by means of the lower second thread guides from an initial position at the outer end of the bobbin chuck to a position in front of the bobbin tubes in such a manner that each thread is brought into a zone in front of a catching means of the corresponding bobbin tube and subsequently by simultaneous take-over all threads are simultaneously brought into the catching means, whereupon they are wound up onto the bobbin tubes.

In its more particular aspects the apparatus for inserting threads and the like is of the type comprising catching means associated with each bobbin tube and a winding device including a first thread guide edge arranged above a thread traversing device. There is further provided for each thread a related second thread guide which is displaceable from a starting position at an outer end of the bobbin chuck along the bobbin tubes and pivotable towards the bobbin tubes. Each second thread guide is connected to a support element. The support elements are interconnected by carrier rods provided with stops. Drive means act on the support element which is arranged at a bearing side of the bobbin chuck. The side-by-side and the double-tiered arrangement of winding devices, on the one hand, and the multiple thread winding, on the other hand, as well as the requirement, that all threads are transferred simultaneously and without danger, in order to achieve uniform bobbin package weights, implies a replacement of the manual transfer of each individual thread.

In a method and in an apparatus as known, for example, from U.S. Pat. No. 4,136,834 granted Jan. 30, 1979, the threads supplied by a supply device are taken over using a manual thread suction device, and subsequently are guided on a thread guide rod at the face side in front of the winding device, using guide notches, jointly as a bundle, but mutually separated. Subsequently the threads, simultaneously moved through the insertion gap of the winding device, are brought using thread eyelets, which are movable along the supporting axis of the bobbin tubes, and which take over the threads, to a mutual distance, which corresponds to the one of the bobbin tubes arranged in a row, in front of the bobbin tubes.

Subsequently a pivoting beam supporting the thread eyelets is pivoted towards, or under, respectively, the bobbin tubes, for effecting the simultaneous insertion of the threads into the catching slots of the bobbin tubes.

Simultaneously with the movement of the thread eyelets the threads are lifted off the guide notches of the thread guide rod, in such a manner that they move freely along the thread guide rod, being eased into their position corresponding to the thread tension.

The movement of the thread eyelets is effected by movable discs, which support the thread eyelets, and which are supported on a rotatable threaded spindle. One of the discs is provided with an inside thread and is moved as a nut (called nut-disc in the following) by the rotating threaded spindle. The other discs are slidably arranged on the spindle and are mutually connected by carrier rods.

The disadvantages of the apparatus cited are seen in that the possible inaccuracies of the disc positions, and the thread positions respectively, in front of the corresponding catching slot are to be compensated for by an additional movement parallel to the axis of the bobbin chuck, in order to ensure, that each thread actually is caught by the catching slot. The possible inaccuracies are caused on one hand by the inexact positioning of the nut-disc by the slow-down run-out of the motor-driven spindle, and on the other hand by the possibility, that the friction between the carrier rod and the disc may exceed the friction between the spindle and the disc.

Due to these conditions also the disadvantageous step of the method is required of moving the threads further in axial direction beyond the positions of the catching slots and moving them back jointly, for ensuring that the threads are caught by the catching slots.

A further disadvantage of the method cited is seen in that the threads first are guided at the end face side in front of the winding device as a bundle (on the guide rod), and only are inserted mutually separated in front of the bobbin tubes (using threadings, spindles and discs) and released.

SUMMARY OF THE INVENTION

Therefore, with the foregoing in mind, it is a primary object of the present invention to provide a new and improved method of, and apparatus for, inserting threads or the like which is not associated with the aforementioned limitations and drawbacks of the prior art methods and constructions.

Now in order to implement this and still further objects of the invention, which will become more readily apparent as the description proceeds, the method of the present development is manifested by the features that the threads, after being placed onto the second thread guides located in their starting position at the outer end of the bobbin chuck, are arranged in an extended position between the first thread guides above the winding device and the second thread guides. During the movement to the position in front of the catching means the threads are caught by a second thread guide edge provided with guide notches above the bobbin tube by said guide notches in such a manner, that at the end of the movement to a position in front of the catching means they are placed accurately in front of the catching means.

The apparatus of the present development for inserting a thread or the like into a winding device is manifested by the features that the first thread guide edge which can be moved (in a manner known as such) such that the thread is guided outside the action zone of the thread traversing device while the first guide edge is in its working position. Below the mentioned first guide edge a second thread guide edge provided with guide notches is provided which can be moved from an idle position to a working position. The number of guide notches corresponds to the number of threads to be wound up. An abutment is provided for positioning an outermost one of the support elements. An innermost one of the support elements is driven using a pneumatic cylinder and is arranged slidably on a shaft on which all of the support elements are slidably and pivotably arranged. In an end position of the support elements the outermost support element rests against the abutment and the outer support elements rest against the stops on the carrier rods. The threads guided by the second thread guides and by the second guide edge, which is in its working position, run substantially vertical, as seen in the direction at right angles to the bobbin chuck axis, and are guided exactly in front of the corresponding catching means.

The advantages achieved using the present invention are seen substantially in that the threads, for taking them over in the catching slots of the bobbin tubes, in simple manner are brought accurately and fixedly with respect to the axial direction of the bobbin tubes to a position in front of the catching slots.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
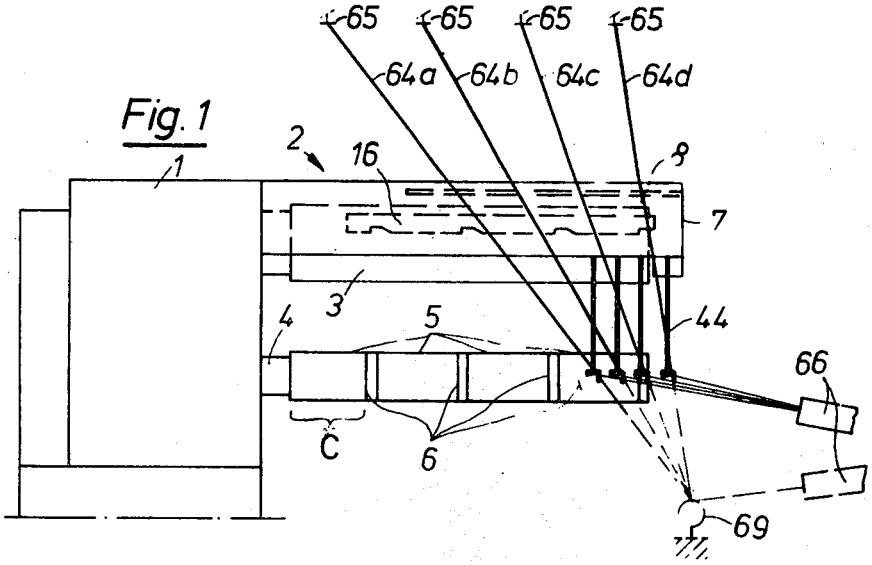
FIG. 1 is a side view of the apparatus according to the invention including a winding device, a bobbin chuck which is shown in a moved-away position and thread guides semi-schematically shown in a position at the outer end of the bobbin chuck.

It is to be understood that in order to simplify the illustration only enough of the construction of the apparatus for inserting threads or the like into a winding device has been shown as needed for those skilled in the art to readily understand the underlying principles and concepts of the invention. Turning now specifically to FIG. 1 of the drawings there is shown in a machine housing 1 of a winding device 2 a friction drive drum 3 and a bobbin chuck 4 are rotatably supported (not shown). The bobbin chuck 4 is movable from a moved-away position (idling position) (FIG. 1) to a moved-up position (working position) and back.

In the moved-up position of the bobbin chuck the bobbin tubes 5 placed and clamped on it contact the friction drive drum 3 and thereby are driven to the desired rotational speed in the direction desired. On each bobbin tube 5 a catching slot 6 for clamping a thread 64*a* to 64*d* caught therein.

First thread guides 65 at the apex of the traversing triangle are arranged substantially above the center of the traversing sweep zone of each bobbin tube 5, as indicated in FIG. 1 for one bobbin tube with the traversing sweep zone C.

In a support element 7 mounted on the machine housing 1 a first thread guide edge 8 is slidably arranged (shown partially). The shifting directions 9*a* and 9*b* (FIG. 5) are determined by the guide pins 10 mounted in the support element 7 and by the guide slots 68, which are provided in the first thread guide edge 8 and cooperate with the guide pins 10. The shifting movement is effected in the direction 9*a* using a pneumatic piston 11, the cylinder 12 of which is mounted (not shown) on the support element 7, and in the other direction 9*b* is effected using a tension spring 13. The tension spring 13 extends between a support element part 7*a* and the first thread guide edge 8. The piston head 14 of the piston 11 rests against the face side 15 of the first thread guide edge 8.

Below the first thread guide edge 8 a second thread guide edge 16 is pivotably and slidably supported using a bearing block 17 mounted on the support element part 7*b* and a further shaft 22 supported rotatably and slidably therein.

The combined pivoting and sliding movement, or spiral movement of the second thread guide edge 16 is enabled by the spiral movement of a grooved drum 20 tightly connected with the shaft 22, during which movement a gliding member 24 connected with a support element part 7*c* extends into a groove 23 of the grooved drum 20.

The spiral movement of the second thread guide edge 16 from a working position (FIG. 4) to a starting position R (FIG. 4) is effected by the tension of a spring 21 arranged between the support block 17 and the grooved drum 20.

The spiral movement of the second thread guide edge 16 in the inverse direction, i.e. from its idling position to its working position, is effected by the force of a pneumatic piston 18, the cylinder 19 of which is mounted (not shown) on the support block 7.

Accordingly the second thread guide edge 16 during its movement from its working position into its idling position effects a backward movement in the direction towards the pneumatic cylinder 19.

The piston head 26 rests against a face side 25 of the grooved drum 20 opposite the spring 21.

The second thread guide edge 16 is provided with four guide notches 27*a*, 27*b*, 27*c* and 27*d* arranged at uniform mutual distances A. The distances A correspond to the mutual distances of the catching slots 6 of the bobbin tubes 5 clamped on the bobbin chuck 4.

Below the two thread guide edges the thread traversing devices 28 (FIG. 4, in FIG. 2 indicated merely), known as such, with the thread traversing guides 29 (FIG. 4) are arranged, which reciprocate within their traversing zone in a manner known as such, moving the thread to and from for building the bobbin package on the bobbin tube.

Below this thread traversing device 28 furthermore a thread guide shifting and pivoting device 30 (FIG. 6) is provided. This device 30 comprises a shaft 31, which is rotatably supported on one hand side in a bearing 32 inserted in a housing part la and on the other hand side in a bearing 33 inserted in a support element part 7*d*.

For preventing any axial shifting movement of the shaft 31, it is provided with a flange 34 resting against the face side of the bearing 32 and the bearing 33 is provided with a cover 35 resting against the face side of the shaft 31.

On the shaft 31 the support members 36*a* through 36*d* are slidably arranged.

With a recess 37 in the support member 36*a* a carrier member 38 of a pneumatic piston 39 engages, the cylinder 40 of which is rigidly connected to the housing part 1*a*. Furthermore, a carrier rod 41 is connected rigidly with the support member 36*a* and frictionally with the support member 36*b*. The support member 36*c* also is provided with a carrier rod 42, connected rigidly with it and frictionally with the support member 36*b*. Furthermore, a carrier rod 43 rigidly connected with the support member 36*d* is connected frictionally with the support member 36*c*. The term "frictionally" in this context is understood to signify a sliding friction within wide tolerance limits.

Figure 4:
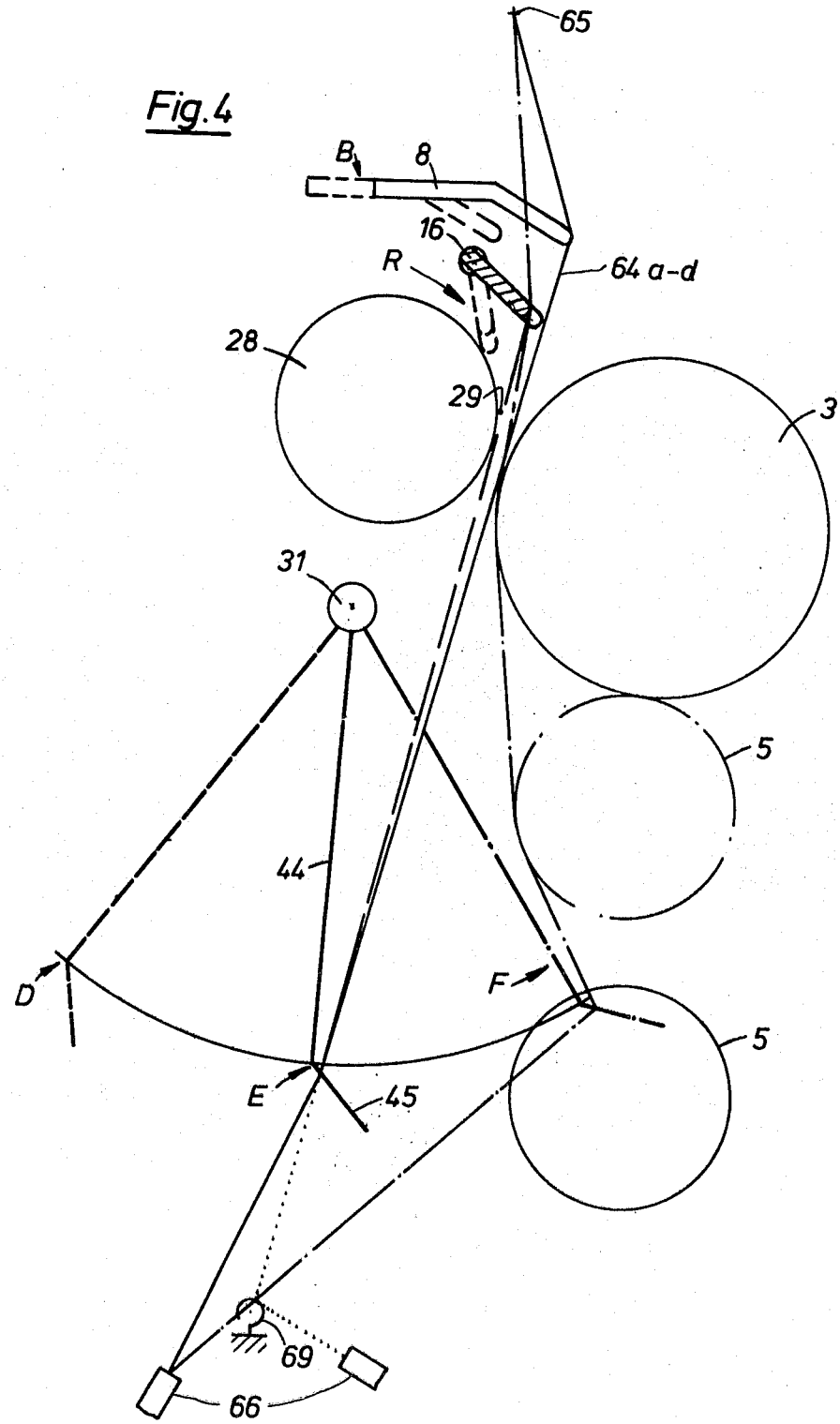
FIG. 4 is a schematic illustration of the thread path during insertion of the thread into the apparatus as shown in FIG. 1.
Figures 5, 6, 7, 8, 9, 10, 11, 12, 13:
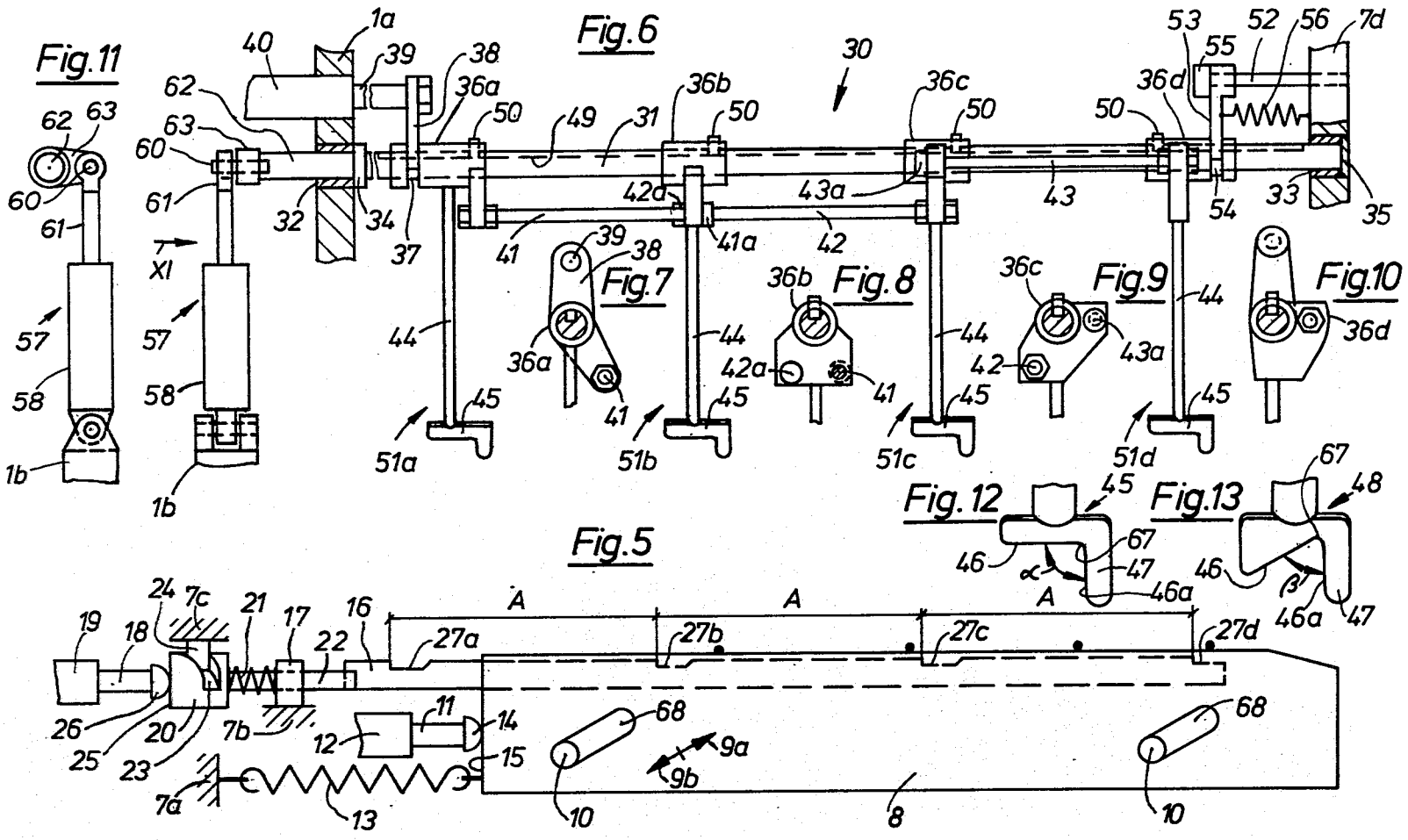
FIG. 5 is a side view semi-schematically showing the first and the second thread guide edges in the apparatus as shown in FIG. 1.
FIG. 6 is a semi-schematic view of the displacing means for the second thread guides in the apparatus as shown in FIG. 1.
FIGS. 7 through 10 show details in section of the displacing means as shown in FIG. 6 and seen in the viewing direction XI.
FIG. 11 shows a detail of pivoting means as shown in FIG. 6 and in the viewing direction of arrow XI in FIG. 6.
FIG. 12 shows a second thread guide in the apparatus as shown in FIG. 6.
FIG. 13 shows a further embodiment of the apparatus according to the invention including modified second thread guides.

A thread guide rod 44 each is mounted on the corresponding support member 36*a*, 36*b*, 36*c* and 36*d* and supports a second thread guide 45 each (FIGS. 4, 6 and 12).

In the second thread guide 45 a thread guide edge 46 together with a second thread guide edge 46*a* of a finger 47 form a guide notch 67 with an angle $\alpha$ of 90 degrees, whereas in another thread guide 48 (FIG. 13), which may be chosen as an alternative instead of the second thread guides 45, the thread guide notch forms an angle $\beta$ of less than 90 degrees, e.g. of 60 degrees. The application of this alternative embodiment is to be explained later.

The support elements 36*a* through 36*d*, the thread guide rods 44 and the second thread guides 45 together form the thread guide elements 51*a*, 51*b*, 51*c* and 51*d*.

In the shaft 31 furthermore a longitudinal groove 49 is provided for frictionally taking up the groove gliders 50 mounted to the support members 36*a*, 36*b*, 36*c* and 36*d*. In this manner the thread guide elements 51*a* through 51*d* are pivoted as the shaft 31 is rotated.

Furthermore a gliding pin 52 (FIG. 6) is mounted in the support element part 7*d* and frictionally engages a carrier member 53, which in turn frictionally engages a groove 54 of the support member 36*d*. An abutment 55 at the end of the gliding pin 52 together with the carrier member 53 is used for limiting the axial movement of the support member 36*d*. Furthermore a tension spring 56 extends between the support element part 7*d* and the carrier member 53.

The shaft 31 is rotated using a crank drive mechanism 57 (FIGS. 6 and 11), comprising a two-level (not shown) pneumatic cylinder 58, pivotably arranged on a housing part 1*b*, a link pin 60 transmitting the force between a link member 61 connected to the end of the piston and a link member 63 connected to the end 62 of the shaft 31.

Insertion of threads 64*a*, 64*b*, 64*c* and 64*d* into the winding device 2, explained with reference to FIGS. 1 and 4 is effected in the following manner:

PHASE 1

The threads 64*a* through 64*d* (FIG. 1), coming first thread guides 65 or from a supply device (not shown), are taken over using a so-called suction gun 66, or using a functionally equivalent suction device, e.g. an automatic suction device (not shown) and are guided to the first thread guide edge 8, brought to its working position (indicated in FIG. 4 with solid lines), and are guided into the second thread guides 45, or into the guide notches 67 respectively.

The thread guides 65 form the apex of the traversing triangle and are arranged substantially above the centre of the traversing sweep zone of each bobbin tube 5, as indicated in FIG. 1 for one bobbin tube with the traversing sweep zone C.

Before the threads 64*a* through 64*d* are inserted manually into the corresponding second thread guides 45, the thread guide elements 51*a* through 51*d* are pivoted, using the first stage of the pneumatic cylinder 58, from a starting position D into a thread receiving position E (FIGS. 4 and 6).

Figure 2:
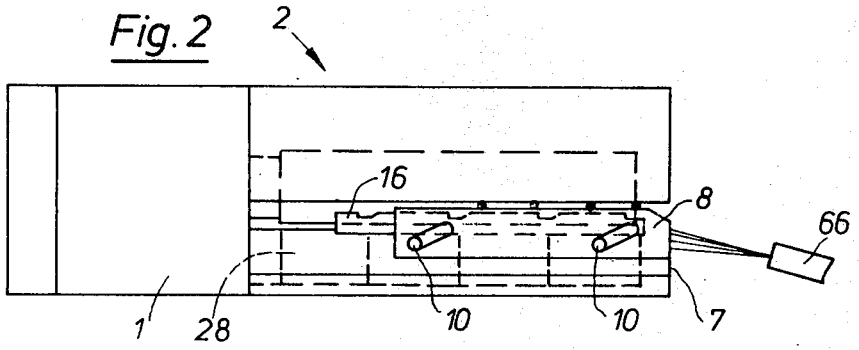
FIG. 2 is a top plan view of the apparatus as shown in FIG. 1 including first and second thread guide edges which are shown semi-schematically.

In this first insertion phase the threads contact, as shown in FIGS. 2 and 5, as well as in FIG. 4 with solid lines, the first thread guide edge 8, but not yet the second thread guide edge 16, which also has been brought into its working position (shown in FIG. 4). In this phase furthermore the threads, as shown in FIG. 4 with solid lines, are not engaged with the traversing thread guides 29 and are arranged freely extended in the space between the first thread guide edge 8 and the second thread guides 45.

PHASE 2

Figure 3:
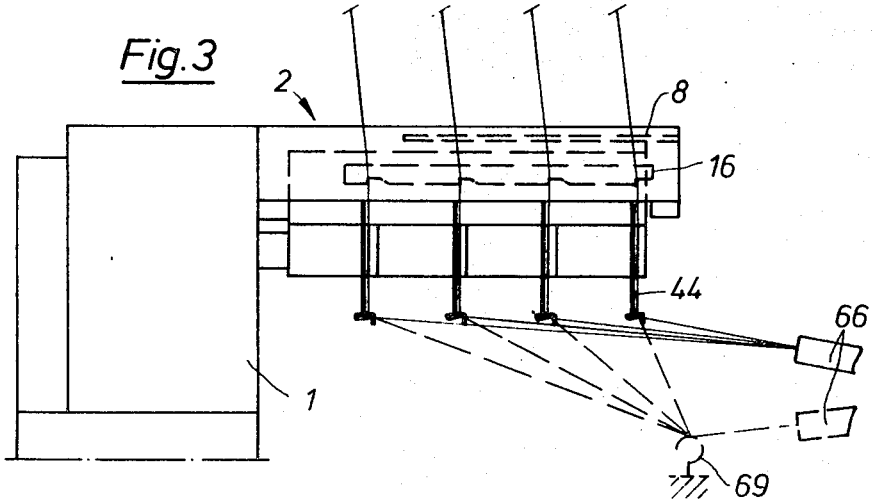
FIG. 3 is a side view of the apparatus similar to FIG. 1 with the bobbin chuck in a moved-up position, and the second thread guides distributed in front of related bobbin tubes.

As can be seen from FIGS. 1, 2 and 5, the thread 64*a* is to be transferred, during the distribution of the threads to positions in front of the corresponding catching slots 6, to the second thread guide edge 16 not before it is located in the position between the guide notches 27*b* and 27*a* (FIG. 5). Thus the second phase, namely the distribution of the threads 64*a* through 64*d* to positions in front of the catching slots 6, is to be controlled in the following manner:

Upon activation of a button (not shown) the pneumatic cylinder 40 (FIG. 6) begins to shift the piston 39, and thus the thread guide elements 51*a* through 51*d* from the starting position shown in FIG. 1 to the position shown in FIG. 3. After some delay the first thread guide edge 8 is moved back into its starting position B under the influence of the tension spring 13 in the direction 9*b*, as the cylinder 12 is released (FIG. 5), in such a manner that the threads 64*a* through 64*d* contact the second thread guide edge 16. In this process each thread is stopped along its path to follow on this guide edge in the corresponding guide notch 27*a* through 27*d*, i.e. the thread 64*a* is stopped in the notch 27*a*, the thread 64*b* in the notch 27*b*, etc.

At the end of this phase 2 the threads 64*a* through 64*d* are arranged, as shown in FIG. 3 and as indicated with dashed lines in FIG. 4, freely extended within the winding device between the notches 27*a* through 27*d* and the second thread guides 45, at the side of the traversing zone C, and accurately in front of the corresponding catching slots 6, and substantially parallel to the latter.

The accurate position of the threads in front of the corresponding catching slots 6 is ensured by the accurate location of the second thread guides 45, the path of movement of which is precisely limited by the stop 53, as well as by the stops 41*a*, 42*a* and 43*a* respectively, which are provided on the carrier rods 41, 42 and 43 respectively, and which are resting against the support members 36*b* and 36*c* in a second extreme position of the second thread guides 45.

Furthermore, the spring 56 holds back the support member 36*d* until the other three support members have reached their mutual distances determined by the stops 41*a*, 42*a* and 43*a* respectively. In this manner the thread 64*d*, when still contacting the guide edge 8, cannot slide away over the notch 27*d* even if e.g. the friction between the support member and the carrier rod would exceed the friction between the support member and the shaft 31.

PHASE 3

In this phase the shaft 31 is rotated, using the second stage of the pneumatic cylinder 58, and thus the thread guide elements 51*a* through 51*d* are jointly pivoted into their position designated F. Thus the threads 64*a* through 64*d* are inserted into the corresponding catching slots 6 and are severed by the suction gun 66, in such a manner that the formation of windings is started.

As the thread guide elements 51 have reached their position F, the pneumatic cylinder 19 is released, in such a manner that the spring 21 brings the grooved drum 20 and thus the second thread guide edge 16 back into the starting position R. In this process the second thread guide edge 16 is pivoted away from the thread path using the spiral movement mentioned. During this spiral movement the threads are guided in the notches 27*a* through 27*d* in such a manner, that between the catching slot 6 and the traversing sweep zone C a number of reserve windings are laid on. At the end of the spiral movement the threads 64 are arranged freely extended between the first thread guides 65 and the bobbin tubes 5, and owing to this thread tension tend to move towards the traversing sweep zone C, and are taken over by the traversing thread guides 29. As the threads are taken over by the traversing thread guides 29, the normal winding process is started.

In a further embodiment of the invention a thread deflection device 69 is arranged in such a manner (indicated with dashed lines in FIGS. 1 and 3), that the threads 64*a* through 64*d* bundled therein and guided on the first thread guide edge 8, as shown in FIG. 1, are caught by the second thread guides 45 during the pivoting movement from the position D (FIG. 4) to the position E.

This embodiment shows the advantage, that the threads 64 do not have to be placed manually into the corresponding second thread guides 45, which further simplifies the method and results in a further time saving.

The method described and the apparatus for implementing the method can be applied also to other thread catching devices, which are provided to the side of the bobbin tubes, e.g. on the bobbin chuck. Such devices replace the above mentioned catching slots 6.

A bobbin chuck of this type is known e.g. from U.S. Pat. No. 4,106,711 and from British Pat. No. 1,562,548.

The third phase, using the bobbin chuck shown in the patents cited, with the conical thread guide surface 11 and the teeth 12, is effected in the following manner:

The thread guide elements 51*a* through 51*d* bring the corresponding threads 64*a* through 64*d* into the position to the corresponding surfaces 11 during the pivoting movement. Under the influence of the prevailing thread tension, generated by the suction gun, the thread glides on the surface 11 into the zone of the teeth 12 and is caught and severed as described in the patents cited.

The position of a surface 11 along the bobbin chuck corresponds substantially to the position of a catching slot 6.

While there are shown and described present preferred embodiments of the invention, it is to be distinctly understood that the invention is not limited thereto, but may be otherwise variously embodied and practiced within the scope of the following claims. Accordingly,

What we claim is:

1. A method of inserting threads or the like into a winding device including at least two traversing devices defining a thread traversing zone, bobbin tubes operatively associated thereto and each bobbin tube being provided with catching means for a related one of said threads, a bobbin chuck having an exterior end and carrying said bobbin tubes, a thread suction device and first thread guide means arranged above said winding device, said method comprising the steps of:

taking up each said thread by means of said thread suction device as the thread comes from said first thread guide means;

arranging lower thread guides in an initial position substantially adjacent said exterior end of said bobbin chuck;

placing said threads onto a second thread guide disposed above said at least two traversing devices and each said thread onto a related one of said lower thread guides in its initial position, so that each said thread is guided outside said thread traversing zone and assumes a substantially straightened position between said first thread guide means and related ones of said lower thread guides;

displacing said lower thread guides from said initial position thereof into a position in which each said thread placed on a related one of said lower thread guides is arranged in a predetermined zone in front of related catching means;

arranging a thread guide edge comprising a plurality of guiding notches, while displacing said lower thread guides from said initial position thereof, so as to catch each said thread in a related one of said guiding notches and such as to ultimately place each said thread by means of the related one of said lower thread guides and the related one of said guiding notches precisely in front of said catching means provided for the related one of said bobbin tubes;

inserting each of said threads into the related one of said catching means; and winding up said threads on said bobbin tubes.

2. The method as defined in claim 1, further including the steps of:

bundling said threads below said lower thread guides in the initial position thereof; and pivoting said lower thread guides from said initial position thereof to a thread take-up position in which all said threads are simultaneously taken up thereby.

3. An apparatus for inserting threads or the like into a winding device, said apparatus comprising:

first thread guides arranged above said winding device;

each said first thread guide being provided for a respective one of said threads;

at least two traversing devices defining a thread traversing zone;

a bobbin chuck defining an axis, an exterior end and a bearing side;

bobbin tubes having an axis and being operatively associated with said at least two traversing devices and supported by said bobbin chuck;

a plurality of thread catching means each operatively associated with a related one of said bobbin tubes;

a first thread guide edge arranged above said at least two traversing devices and displaceable into an operative position in which said threads are guided outside said thread traversing zone defined by said at least two traversing devices;

a predetermined number of second thread guides each operatively associated with a related one of said threads;

means for displacing said second thread guides from a first extreme position adjacent said exterior end of said bobbin chuck along said bobbin tubes to a second extreme position and for pivoting said second thread guides towards said bobbin tubes;

a second thread guide edge arranged below said first thread guide edge and provided with a plurality of guiding notches corresponding to the number of said threads to be wound up;

said second thread guide edge being displaceable between an idle position and an operative position;

a predetermined number of support elements each of which is connected to a related one of said second thread guides and which include an outermost support element and an innermost support element with respect to said bearing side of said bobbin chuck;

a predetermined number of carrier rods interconnecting said support elements and provided with related stops;

an abutment defining a predetermined position of said outermost support element;

a shaft slidably and pivotably carrying all said support elements;

drive means acting on said innermost support element in order to displace said second thread guides between said first and second extreme positions;

said outermost one of said support elements, in said second extreme position thereof, engaging said abutment and the remaining ones of said support elements engaging said stops on said carrier rods; and each said thread, as it is guided by the related one of said second thread guides in said second extreme position thereof and by said second thread guide edge in said operative position of said second thread guide edge, extending essentially vertically as viewed in a direction normally with respect to said bobbin tube axis and precisely in front of a related one of said catching means.

4. The apparatus as defined in claim 3, further including:

a further shaft defining a rotational axis and being operatively connected to said second thread guide edge; and said second thread guide edge being pivotable about said rotational axis between said idle position and said operative position thereof.

5. The apparatus as defined in claim 4, further including:

means for simultaneously displacing said second thread guide edge in the direction of said rotational axis of said further shaft.

6. The apparatus as defined in claim 3, further including:

spring means for delaying the displacement of said outermost support element with respect to the remaining ones of said support elements.

7. The apparatus as defined in claim 3, wherein:

each said second thread guide comprises a guiding notch formed by two edges;

said two edges defining an angle which does not exceed 90°; and one of said edges being located in a plane extending substantially normally with respect to said axis of said bobbin chuck.

8. The apparatus as defined in claim 3, further including:

a thread deflection device located below said second thread guides in said first extreme position thereof;

said thread deflection device and said first thread guide edge guiding therebetween all said threads in said first extreme position of said second thread guides;

said second thread guides being pivotable by said displacing means from said first extreme position to a thread take-over position; and said second thread guides when pivoted from said first extreme position to said thread take-over position thereof entraining each related one of said threads which are guided between said first thread guide edge and said thread deflection device.

* * * * *